United States Patent [19]

Dunning

[11] Patent Number: 4,939,783

[45] Date of Patent: Jul. 3, 1990

[54] SUSPENDED SPEAKER SYSTEM

[76] Inventor: William S. Dunning, Hollow Rd., Clinton Corners, N.Y. 12514

[21] Appl. No.: 303,640

[22] Filed: Jan. 30, 1989

[51] Int. Cl.[5] ..... H04R 1/02

[52] U.S. Cl. ..... 381/188; 381/205; 381/159; 381/88; 181/171; 181/172; 181/150

[58] Field of Search ..... 381/188, 205, 158, 159, 381/88; 181/172, 171, 150

[56] References Cited

U.S. PATENT DOCUMENTS

| | | | |
|---|---|---|---|
| Re. 18,751 | 2/1933 | Weinberger | 381/159 |
| 2,840,177 | 6/1958 | Shoengold | 181/172 |
| 4,384,174 | 5/1983 | Suzuki | 381/188 |
| 4,797,935 | 1/1989 | Tanaka | 381/205 |

*Primary Examiner*—Jin F. Ng
*Assistant Examiner*—M. Nelson McGeary, III
*Attorney, Agent, or Firm*—Hough, William T.

[57] ABSTRACT

In a preferred embodiment, a speaker system within a closed wooden cabinet in which the speaker is suspended in closed cell foam within a cabinet speaker circular-port, devoid of rigid attachment of the foam and of the speaker to the cabinet, the closed-cell foam being mounted in an open-ended slot between flanges mounted on the speaker cabinet, and the speaker magnet being supported by a resilient gasket mounted on the cabinet by a gasket-support structure, and a rear port being closed by an inner non-porous membrane and an outer porous fabric membrane having foam therebetween, mounted within a membrane-support frame that is suspended within open cell foam suspended within the rear port devoid of rigid attachment to the cabinet, supported between inner and outer flanges mounted on the cabinet, the cabinet being devoid of open ports.

17 Claims, 2 Drawing Sheets

SUSPENDED SPEAKER SYSTEM

PRIOR ART STATEMENT

While a novelty patentability search in class 383, subclasses 158, 159 and 188 and class 181, subclasses 171 and 172 failed to reveal any patents of significant relevance to the invention, typical prior art in which one or both of speaker structure and/or supporting rubber-supports or elastic material are widely spaced far-apart and/or rigidly attached to the cabinet structure, are prior art patents such as Hathaway U.S. Pat. No. 4,289,929 dated Sep. 15, 1981, Bussard U.S. Pat. No. 2,198,243 dated Apr. 23, 1940, Schultz U.S. Pat. No. 2,154,705 dated April 18, 1939, and Jacobsen U.S. Pat. No. 4,440,260 dated Apr. 3, 1984.

BACKGROUND TO THE INVENTION

Prior to the present invention, attempts to reduce vibrations and distorting cabinet sound arising from vibrations of speaker-mounting cabinets have been failed to solve or avoid the many such problem and their causes, for a multitude of reasons. In the prior art, any potential beneficial presence of rubber or other elastic material typically as a gasket has been thwarted by the continued use of rigid attachments heretofore typically considered been essential for those structures—such as the use of screws and/or bolts and nuts, to support the heavy weight of the speaker and the speaker-magnet thereof. In absence of such supporting screws and/or bolts and nuts, soft rubber or other soft elastic material inserted with the intent of attenuating or absorbing speaker vibrations, would not be durable and would permit the heavy speaker and its heavy speaker-magnet-promptly sag to such an extent that the speaker would soon make direct contact with the cabinet structure and/or would compress the lower supporting elastomer or rubber sufficiently that vibrations of the speaker during use would continue to be transmitted directly or through the compacted or compressed rubber or elastomer, to the speaker cabinet structure (as typically is the case with the above-noted Hathaway patent). As above-noted, the supporting rubber or elastomer has been intermittently placed at widely spaced far-apart locations, and in order to prevent sagging and above-noted problems, the rubber or other elastomer has had to be extremely firm and rigid rubber—sufficiently rigid (for example) to be grasped and held by a bolt or screw (such as by the above-noted Schultz patent) or to be rigidly clamped and adhered (as in the above-noted Jacobsen patent), such that the rigidity and major firmness of such rubber or elastomer in fact inherently detrimental continues to transmit vibrations therethrough to the speaker cabinet structure. It is noted therefore that prior to the present invention there existed continued problems if the rubber or elastomer was too soft or widly space far-apart as above-noted, and on the other hand, also if the rubber or elastomer were sufficiently firm as to permit it to be screwed-down or bolted or clamped or adhesively secured in order for the rubber or elastomer to continue to be capable of supporting the heavy speaker and its heavy speaker-magnet both initially and durably over extended periods of time and use. It is also noted that whenever rubber or elastomer has been employed, there has been a consistent absence of specificity as to the degree of resiliency required, although the normal inference was that greater benefits were obtained in direct proportion with greater softness thereof (i.e. softer, less firm elastomer or rubber). This inference appeared to be present even though above-noted negating inconsistencies existed, such as the required excessive firmness or rigidity required for it to be adequately subject to be anchored by clasps, glue (adhesive) and/or clamps and/or bolts or screws as typified by the above-noted prior art patents.

Additionally, undesirable noises and vibrations, and/or metallic or hard sounds escape through open ports, as opposed to "closed" inner-space (no open port(s)). On the other hand, a closed cabinet devoid of open ports in its side(s), top and/or rear wall(s) promote vibrations because of compressed air therein transmitting vibrations to and vibrating the speaker cabinet.

Also, while a speaker cabinet need not be wooden or of a composite wood-composition, but may be and often is non-wood structures such as solid plastic or plastic composite structures, in the past the undesirability of closed wooden cabinets has arisen from the aforestated problems of vibrations of the wooden cabinet structure because of the trapped non-vented enclosed air which becomes compacted and thereby becomes a vibration-transmitting media to the wood during use of the speaker.

OBJECTS OF THE INVENTION

Object of the invention include the overcoming and/or avoiding of above-noted problems and difficulties, and to eliminate distortions of both the frame and loudspeaker cone caused by random or spaced clamping by hard bolts and/or screws used to attach loudspeakers to enclosure structure.

Another object is to provide concurrently adequate support sufficient to prevent sagging of the speaker and heavy magnet thereof, while avoiding rigid connections and/or employment of hard or too firm rubber or too firm elastomer that would inherently continue to transmit sound vibrations from speaker structure directly to the cabinet structure.

Another object is to obtain a closed space speaker cabinet system devoid of open ports (ports by which interior and exterior space directly communicate) to achieve improved sound quality, particularly with wooden closed cabinets, while concurrently avoiding undesirable vibrations inherently normally associated with closed systems.

Another object is to provide mounting enabling the speaker frame to most freely vibrate in conjunction with the speaker cone devoid of transferred sound distortions of prior art speaker-frame peripheral-mountings.

Other objects become apparent from the preceding and following disclosure.

The objects are obtained by the invention as disclosed herein.

SUMMARY OF THE INVENTION

Broadly the invention may be described as follows. As noted-above, prior cabinet speaker systems have existed heretofore, inclusive of a speaker-port of which the cabinet structure forming the speaker port mounts a speaker-magnet speaker unit within the speaker port. That speaker-magnet speaker unit conventionally integrally includes a speaker magnet unit integral with a speaker diaphragm and speaker diaphragm support structure that mounts (i.e. carries) the diaphragm onto the speaker diaphragm support structure, and with the speaker diaphragm integral with (i.e. connected to and mounted operatively on) the speaker magnet. The present inventive improvement(s) broadly include(s) the requirement that the speaker mounting-port structure critically have in particular critical closed-cell elastomer-foam (resilient) placed substantially continuously throughout an open-ended slot-space formed by the speaker cabinet support structure, along an inner peripheral port-circumscribing edge also formed by the speaker cabinet support structure. Additionally a substantially continuous outer circumscribing edge of the speaker unit support structure is mounted within and is retainably supported solely by the above-noted closed-cell foam, as opposed to any rigid connection using rigid elastomer and/or using clamps or bolts or the like. Accordingly, by this arrangement, each of the speaker cabinet's mounting-port structure with its inner peripheral circumscribing edge and the closed-cell foam is/are each free from rigid connection to the speaker outer circumscribing edge of the speaker unit support structure. As above-noted, this inventive novel arrangement is in sharp contrast to and significantly different from the prior art systems typified by preceding prior art discussed above. The critical closed-cell foam conventionally by virtue of being "closed-cell", has sufficient necessary (critical) strength to support a heavy speaker unit and heavy magnet thereof, combined with also having sufficient essential (critical) resiliency to attenuate and/or absorb undesired speaker-support vibrations, if the closed-cell foam is employed as above-stated in a substantial continuous array within the circumscribing slot above-noted. While providing sufficient strength as to not become compressed, as contrasted to open-cell foam which would be too weak, the closed-cell foam simultaneously provides sufficient resilience as to insulate against transmission of vibrations and shock between the speaker unit's outer circumscribing edge non-rigidly supported by the closed-cell foam within the speaker cabinet port. While it would be within the spirit and scope of the invention to have minor or very small insignificant gaps in or spaces between the positioning of portion(s) of the closed cell foam, to have the portions spaced-apart at-all would result in varying degrees of diminished benefits of the afore-stated advantages and achievements of the present invention.

In a preferred embodiment, the speaker unit support structure includes substantially continuous spaced-apart opposing inner and outer flanges positioned (preferably in substantially parallel planes) to form the above-noted open-ended slot-space, thereby providing for nesting the closed-cell foam retainably between the opposing inner and outer flanges, with speaker unit's outer circumscribing edge nested within the closed-cell foam, devoid of structures otherwise rigidly attaching the foam or the outer circumscribing edge to the spaced-apart flanges.

In a preferred embodiment achieving improved clarity of sounds in both high and low sound frequencies, by virtue of uniformity length dimensions of the speaker cone, taken together with afore-stated structures and advantageous results thereof, the open-ended slot space, and speaker-port formed thereby, extending longitudinally in a substantially circular configuration or shape.

In a preferred embodiment, enhancing above-noted benefits, the speaker unit support structure includes a cabinet structure substantially enclosing the speaker unit with its diaphragm and magnet thereof, with or without being open ports to the enclosed space thereof.

In another preferred embodiment, taken together with aforestated structures and advantageous results thereof, the speaker cabinet forms a closed inner-space system devoid of "open" port(s), thereby totally enclosing the speaker unit with its diaphragm and magnet thereof, within closed space as a closed space system.

In another preferred embodiment, there is provided a pressure-vent port closed by a membrane-combination mounted within another open-ended slot formed in a wall spaced-away from the speaker magnet unit of the speaker unit. As in the case of the mounting of the speaker, the membrane-combination is mounted within foam and the foam is retainably mounted within this addition other open-ended slot formed in the spaced-away wall. The membrane combination includes a membrane mounting structure tautly mounting an inner non-porous membrane and in opposing relationship to a tautly-mounted non-porous membrane, the membrane mounting structure also tautly mounting a porous membrane, with a resilient matter such as preferably foam (more preferably being non-closed cells type, i.e. preferably very soft elastomer) positioned within mounting space and compressed between the opposing taut inner and outer mounted membranes. The closed space within the cabinet is in contact with the non-porous inner membrane, and the porous outer membrane communicates with exterior space. By the above-noted mounting of these membranes, the non-porous inner membrane closes-off the closed space within the cabinet, together with the outer peripheral edges of the membrane-combination and its circumscribing mounting foam are free from rigid connection with each other and free from rigid connection with structure forming the associated open-ended slot. Typically, the non-porous membrane is of any conventional or desired non-porous pliable or flexible and/or resilient plastic or other material such as typically rubber, polyester, polyethylene, or the like. The porous membrane may be any of conventional porous plastics or weaves thereof or of any conventional fabric or cloth such as cotton, wool or the like.

In a more preferred embodiment that has the port closed by the membrane combination above-described, the structure forming this additional open-ended slot is similar or identical to the two opposing flange arrangement above-described for the mounting of the closed-cell foam that supports the speaker unit. Thus, likewise, this second open-ended slot may be formed by second substantially continuous spaced-apart inner and outer opposing flanges extending in substantially parallel planes, preferably continuing to form a preferred circular shape circumscribing a preferred circular venting port as the back (rear) wall rear port. The circular configuration has the same benefits as previously described.

More preferably, the above-desribed closed-port and mounted membrane-combination are in a wall positioned behind the speaker unit and its speaker-magnet, which would normally be the cabinet back wall. Such arrangement of flexible taut membranes together with the enclosed soft elastomer (or equivalent conventional synthetic or natural fibrous material or composition) therebetween better attenuates and/or absorbes compressed air pressure waves emitted by and from the back of the speaker magnet and the associated diaphragm, thereby preventing vibrations of the speaker cabinet wall(s).

In a further preferred embodiment, a perforated baffle is exteriorly mounted over and substantially closes the rear port above-noted, but essentially including one or more, preferably multiple perforations to allow free flow of air in alternate directions therethrough consistent with vibrating air as the above-noted membanes vibrate alternately inwardly and outwardly responsive to vibrations from the speaker units diaphragm and magnet thereof above-noted, during use thereof. The presence of this baffle, taken together with the soft material (such as open-cell foam) between the above-noted membranes), serve(s) to attenuate and muffle hard and/or rasping and/or metal or clicking sounds that characterize many conventional prior art speakers and cabinets thereof. The baffle is typically a board or sheet of wood or of conventional or desired plastic composition, or of any desired composite composition, preferably being of wood or some conventional sound attenuating composition such as cork or small wood particle composition.

Also preferably, the interior surface of the speaker cabinet includes a liner of conventional sound attenuating sheet or board on one or more of the speaker cabinet's inner wall surfaces. Likewise, such material may be any conventional sound attenuating composition such as those above-noted, whereby the cabinet is further insulated against hard or metallic sound vibrations that distort the musical vibrations intended to be heard as clearly emitted from the speaker diaphragm.

Taken together with any one or more of the preceding embodiments, more optimal results in terms of tone clarity and lack of hard sounds, together with the benefits of wood-resonance of sound, comparable to that obtained from a violin or any wood-wind instrument, is obtained, thereby optimizing the present invention.

The invention may be better understood by making reference to the following Figures.

THE FIGURES

DETAILED DESCRIPTION

The above-noted Figures all relate to a common embodiment embodying all preferred features of this invention, and accordingly for commonly-illustrated elements in the several Figures, indicia are the same. Once described for one Figure, indicia description is not repeated, except in some instances for purposes of facilitating clarity and understanding.

Figure 1:
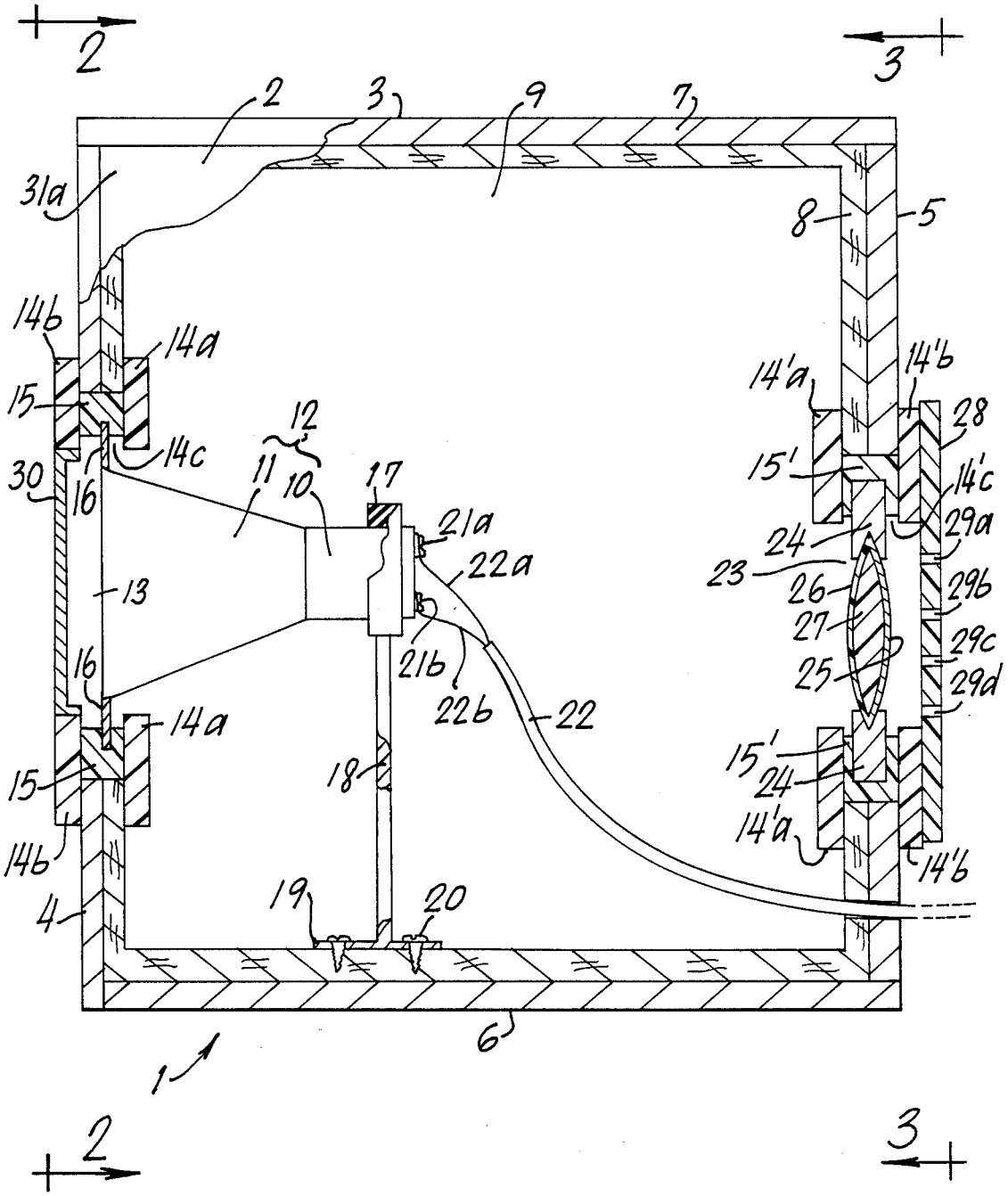
FIG. 1 illustrates a side view with predominant cut-away showing side cross-sectional view of a speaker cabinet and the mounted speaker unit thereof, embodying the preferred embodiments above-described of this invention.

FIG. 1 illustrates broadly a speaker cabinet combination 1 having the outside wooden cabinet 2 having its top 3, its front 4, its back (rear) 5 and its bottom 6. The cabinet's outer casing for its top, bottom, back, front, bottom and sides, is the wooden sheets typically and preferably of solid oak, but optionally of other wood such as maple, walnut or the like. The inside liner 8 (typically adhered adhesively to the inner surface(s) of the outside wooden cabinet 2) is typically small particles of wood or sawdust adhered together with resin such as, for example, the commercial product known as VERSABOARD (trademark). By virtue of no "open" ports, there is the enclosed or closed-space 9. The speaker unit includes the conventional or desired speaker-magnet 10 having conventionally and operatively-fastened diaphragm 11 which jointly make-up the speaker unit 12, apart from the speaker unit-support structure 16. The outer circumscribing edge of the speaker-unit support structure 16 is mounted and retainably supported in the closed-cell foam 15. The closed-cell foam is of any conventional or desired type elastomer having the critical characteristics previously described, and such closed-cell foam is commercially available. The closed-cell foam 15 is mounted between and retained by the opposing outer flange **14*b* and inner flange 14*a*, of which the outer flange is typically mounted on an outer surface of the cabinet front 4 and the inner flange is typically mounted on the inner surface of the liner 8 thereby forming therebetween a open-ended slot 14*c*; the term open-ended slot is intended to have the meaning of the illustrated slot 14*c*, i.e. an open recess space formed between the above-identified inner and outer flanges, here illustrated as plastic composition. The speaker magnet 10 is shown supported by the encompassing rubber gasket 17 supported on a metal optional preferred support 18 having support base 19 mounted by screws 20 on the liner 8. Conventional circuit wire-mounting screw 21*a* and 21*b* are shown with conventional circuitry attached wires 22*a* and 22*b* of lead wire 22 (shown in-part). The rear venting-port 23 is closed-off by the membrane-combination that includes membrane-mounting structure 24 tautly-mounting inner non-porous membrane 26 and outer porous membrane 25 with compressed open-cell elastomer 27 compressed therebetween. The membrane-mounting structure 24 is mounted and retainably supported within the elastomer or foam 15' within open ended slot 14'*c* formed between the opposing inner flange 14'*a* and outer flange 14'*b* extending in substantially parallel planes. The inner flange 14'*a* is mounted on a face of the liner 8, while the outer flange 14'*b* is typically mounted on an outer surface or face of the rear side or panel 5. The rear perforated baffle 28 is mounted on the flange 14'*b*, the typical perforations being identified as perforations 29*a* through 29*d*. Conventionally, over the speaker opening of speaker 12, there is provided a porous cloth 30**.

Figure 2:
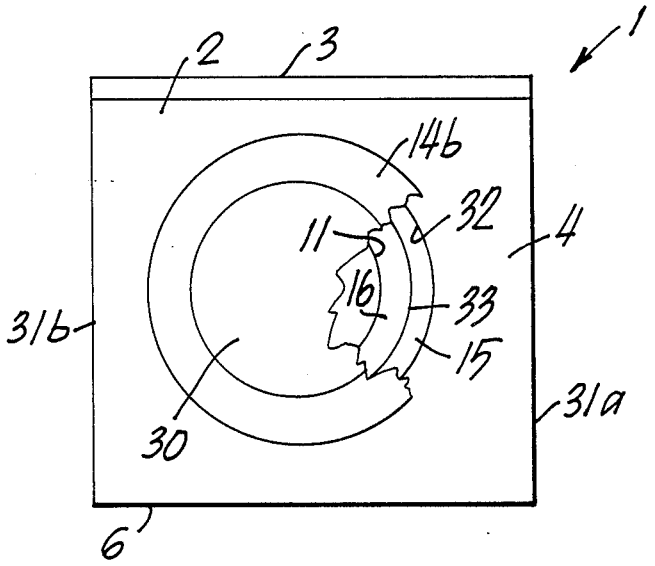
FIG. 2 illustrates a front view of the embodiment of FIG. 1 with partial cut-away, taken along lines 2—2 of FIG. 1.

FIG. 2, being a view taken along line 2—2 of FIG. 1, illustrated the opposite sides **31*a* and 31*b* as the inventive speaker system 1 is illustrated in front view with partial cut-away. In the partial cut-away of the flange 14*b* and the porous cloth 30, there is seen the speaker diaphragm 11 and the circular speaker-diaphragm mounting structure 16 having its outer circumscribing edge 33 mounted and retainably secured within the circular (annular) closed-cell foam 15 within the round (circular) speaker port 32 of the front 4 of the cabinet 2**.

Figure 3:
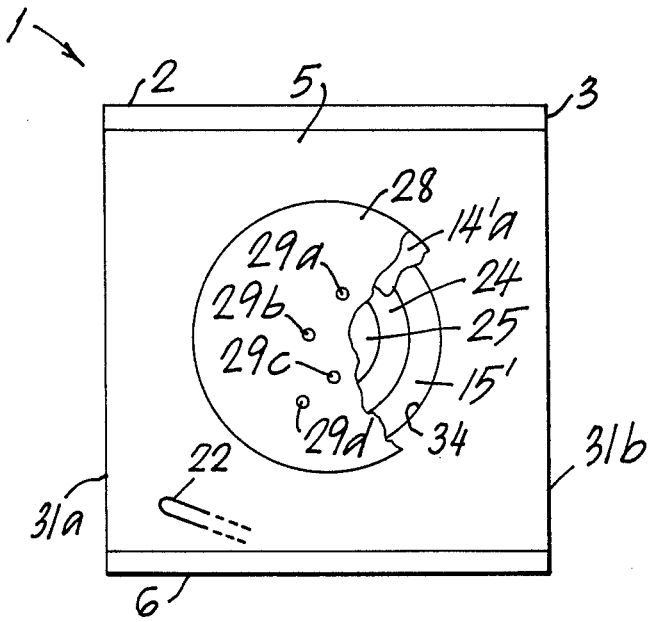
FIG. 3 illustrates a rear view of the embodiment of FIG. 1 with partial cut-away, taken along lines 3—3 of FIG. 1.

FIG. 3, being a view taken along line 3—3 of FIG. 1, illustrates a view of the rearward side of the cabinet 2, and thus of rear side 5, together with the above-described rear vent-port 34 closed by the membrane combination inclusive of the outer membrane 25, the membrane mounting structure 24, the foam or elastomer 15' and the outer flange **14'*a*, as well as the cut-away baffle 28** with its above-noted perforations.

It is within the scope of the present invention to make such variations and modifications and substitution of equivalents as would be apparent to a person of ordinary skill in this art.

I claim:

1. A speaker system comprising in combination: (a) a speaker unit integrally including a magnet and a diaphragm and a diaphragm support structure for mounting the diaphragm, and (b) a speaker cabinet having a mounting-port, the improvement comprising: (1) said mounting-port comprising a first inner peripheral port-circumscribing edge and first substantially continuous spaced-apart inner and outer substantially opposing flanges that extend in substantially parallel planes and form a first open-ended slot-space therebetween, extending substantially continuously along and secured rigidly adjacent said inner peripheral edge; (2) first closed-cell foam mounted within and substantially throughout said first open-ended slot-space; and (3) said diaphragm support structure having a substantially continuous outer circumscribing edge, said outer circumscribing edge being mounted within and retainably supported by said first closed-cell foam such that said outer circumscribing edge and said first closed-cell foam are each free from rigid connection to said speaker cabinet and from rigid connection to said mounting port.

2. The speaker system of claim 1, wherein said speaker cabinet forms an enclosure space substantially enclosing said speaker unit.

3. The improvement of claim 2, in which said speaker cabinet and the enclosure space thereof, forms a closed space.

4. The speaker system of claim 1, including an accessory magnet-support structure mounting said magnet of said speaker unit, said accessory magnet-support structure including resilient material positioned such that the speaker magnet unit is resiliently supported.

5. The speaker system of claim 1, wherein said mounting-port and said first open-ended slot space are each substantially circular in shape.

6. The speaker system of claim 1, said speaker cabinet further including (4) a back wall spaced away from and behind said magnet unit, said back wall having a rear port formed therein by back wall port-forming circumscribing structure comprising a second inner peripheral edge and second substantially continuous spaced-apart inner and outer opposing flanges that extend in substantially parallel planes and form a second open-ended slot-space therebetween, extending substantially continuously along and secured rigidly adjacent said second inner peripheral edge, (5) resilient composition retainably mounted within and substantially throughout said second open-ended slot-space and (6) a membrane-combination comprising a membrane frame mounting structure, a non-porous membrane tautly extended and supported by said membrane frame mounting-structure, an exterior membrane tautly extended and supported by said membrane frame mounting structure substantially adjacent to said non-porous membrane forming a mounting-space therebetween, and resilient matter mounted within said mounting-space substantially compressed and in contact with each of said porous membrane and said non-porous membrane, said membrane frame mounting-structure having outer peripheral edges mounted in and retainably supported by said second closed cell foam with the outer peripheral edges positioned such that said outer peripheral edges and said second foam are each free from rigid connection to each of said back wall port-forming circumscribing structure and said second substantially continuous spaced-apart inner and outer flanges thereof.

7. The improvement of claim 6, including (7) a perforated baffle exteriorly mounted over and substantially closing said rear port, mounted onto said back wall port-forming circumscribing structure at a location exterior to said exterior membrane.

8. The improvement of claim 1, in which a major and predominant portion of said speaker cabinet comprises wood.

9. The improvement of claim 2, in which said speaker cabinet has inner wall surfaces, and including an inner lining of a sound attenuating composition mounted on said inner wall surfaces.

10. A speaker system comprising in combination: (a) a speaker unit integrally including a magnet and a diaphragm and a diaphragm support structure for mounting the diaphragm, and (b) a speaker cabinet having a mounting-port, the improvement comprising: (1) said mounting-port comprising a first inner peripheral port-circumscribing edge and a speaker support unit forming a first open-ended slot-space, said speaker support unit extending substantially continuously along and secured rigidly adjacent said inner peripheral edge; (2) first closed-cell foam mounted within and substantially throughout said first open-ended slot-space; and (3) said diaphragm support structure having a substantially continuous outer circumscribing edge, said outer circumscribing edge being mounted within and retainably supported by said first closed-cell foam such that said outer circumscribing edge and said first closed-cell foam are each free from rigid connection to said speaker cabinet and from rigid connection to said mounting port.

11. The speaker system of claim 10, wherein said speaker cabinet forms an enclosure space substantially enclosing said speaker unit.

12. The improvement of claim 11, in which said speaker cabinet and the enclosure space thereof, forms a closed space.

13. The speaker system of claim 10, including an accessory magnet-support structure mounting said magnet of said speaker unit, said accessory magnet-support structure including resilient material positioned such that the speaker magnet unit is resiliently supported.

14. The speaker system of claim 10, wherein said mounting-port and said first open-ended slot space are each substantially circular in shape.

15. The speaker system of claim 10, said speaker cabinet further including (4) a back wall spaced away from and behind said magnet unit, said back wall having a rear port formed therein by back wall port-forming circumscribing structure comprising a second inner peripheral edge and a speaker support unit forming a second open-ended slot-space, said speaker support unit extending substantially continuously along and secured rigidly adjacent said second inner peripheral edge; (5) resilient composition retainably mounted within and substantially throughout said second open-ended slot-space and (6) a membrane-combination comprising a membrane frame mounting structure, a non-porous membrane tautly extended and supported by said membrane frame mounting-structure, an exterior membrane tautly extended and supported by said membrane frame mounting structure substantially adjacent to said non-porous membrane forming a mounting-space therebetween, and resilient matter mounted within said mounting-space substantially compressed and in contact with each of said porous membrane and said non-porous membrane, said membrane frame mounting-structure having outer peripheral edges mounted in and retainably supported by said second closed cell foam with the outer peripheral edges positioned such that said outer peripheral edges and said second foam are each free from rigid connection to each of said back wall port-forming circumscribing structure.

16. The improvement of claim 15, including (7) a perforated baffle exteriorly mounted over and substantially closing said rear port, mounted onto said back wall port-forming circumscribing structure at a location exterior to said exterior membrane.

17. The improvement of claim 16, in which said speaker cabinet has inner wall surfaces, and including an inner lining of a sound attenuating composition mounted on said inner wall surfaces.

* * * * *